US008748765B2

(12) United States Patent
Kokubu et al.

(10) Patent No.: US 8,748,765 B2
(45) Date of Patent: Jun. 10, 2014

(54) MOUNTING STRUCTURE OF CONTACT MEMBER IN SWITCH DEVICE

(75) Inventors: Taito Kokubu, Tokyo (JP); Hideji Onodera, Tokyo (JP)

(73) Assignee: Valeo Japan Co., Ltd., Tokyo (JP)

( * ) Notice: Subject to any disclaimer, the term of this patent is extended or adjusted under 35 U.S.C. 154(b) by 213 days.

(21) Appl. No.: 13/477,781

(22) Filed: May 22, 2012

(65) Prior Publication Data

US 2012/0318652 A1 Dec. 20, 2012

(30) Foreign Application Priority Data

Jun. 20, 2011 (JP) ..... 2011-136553

(51) Int. Cl.
*H01H 1/64* (2006.01)

(52) U.S. Cl.
USPC ..... 200/293; 200/252; 200/570; 200/178

(58) Field of Classification Search
USPC ..... 200/293, 178, 252, 255, 257, 273, 570, 200/571, 572
See application file for complete search history.

(56) References Cited

U.S. PATENT DOCUMENTS

| | | | | |
|---|---|---|---|---|
| 5,898,142 | A * | 4/1999 | Ohtaki et al. | 200/16 C |
| 6,674,183 | B1 * | 1/2004 | Noda et al. | 307/132 E |
| 7,045,728 | B2 * | 5/2006 | Mitsui | 200/252 |
| 7,067,751 | B2 * | 6/2006 | Nishimura et al. | 200/293 |

* cited by examiner

*Primary Examiner* — Kyung Lee
(74) *Attorney, Agent, or Firm* — Rader, Fishman & Grauer PLLC

(57) ABSTRACT

A contact point member comprises contact point pieces extending from both ends of a base portion and a gripping portion extending from the center of the base portion. The base portion is placed on an upper surface of a holding portion in a base member and is inserted between a main wall of a surrounding wall and stoppers on the holding portion for positioning. After a front end of the base portion is pressed and inserted under a presser portion provided in the main wall, when the gripping portion is pressed on the holding portion, an engagement piece formed in the rear end of the gripping portion is engaged to a corner hole formed in a projection of the holding portion, thus preventing the falling-down of the contact point member. The mounting operation of the contact point member is easily completed simply by pressing down the gripping portion.

12 Claims, 14 Drawing Sheets

5(A)

5(B)

5(C)

7(A)

7(B)

14(A)

14(B)

MOUNTING STRUCTURE OF CONTACT MEMBER IN SWITCH DEVICE

CROSS-REFERENCE TO RELATED APPLICATION

This application claims priority under 35 USC 119 from Japanese Patent Application No. 136553/2011 filed on Jun. 20, 2011, the disclosure of which is incorporated by reference herein.

BACKGROUND OF THE INVENTION

1. Field of the Invention

The present invention relates to a mounting structure of a contact point member in a switch device.

2. Description of the Related Art

For example, a switch device for power window control in a vehicle is structured such that, a slider, in which a contact point member (movable contact point) is mounted to a base member, is provided to a fixed side contact point, wherein the contact point member is connected and disconnected from the fixed side contact point by sliding the slider. A switch device disclosed in Japanese Utility Model Laid-Open No. 6-82738 as such a switch device is structured such that a fixed contact point is formed on an insulating substrate and a knob supported in a casing is rotated to slide a slider coupled to the knob along the insulating substrate, thus connecting and disconnecting a contact point member of the slider from the fixed contact point.

FIG. 12 is a perspective view showing the contact point member in the slider disclosed in Japanese Utility Model No. 6-82738. FIG. 13 is a cross section showing a base member and the contact point member before the contact point member is mounted. FIG. 14A is a longitudinal cross section showing the slider in which the contact point member is mounted in the base member. FIG. 14B is a cross section taken along section B-B in FIG. 14A. A contact point member (movable contact point) 60 is formed of a plate spring member and includes a base portion 61 an outer configuration of which is rectangular as a basic shape, a pair of contact point pieces (resilient contact portions) 62 (62*a* and 62*b*) extending from both of right and left end sections of the rear edge in the base portion 61, and a grasping portion 65 extending from the central section of the same rear edge. The contact point piece 62 is formed to extend under the base portion 61 from the bottom portion, that is, to be folded back obliquely in a front direction and has a contact point portion 63 at the tip end bulged in a semi-arc shape toward a side away from the base portion 61. The grasping portion 65 is formed in a rectangular shape to extend backward and to be inclined slightly upward. A rectangular hole 66 is formed in the center of the base portion 61, and an engagement piece (resilient engagement portion) 67 extends in a backward, oblique, and upper direction from the front hole edge.

A base member (contact point holder) 70 is made of resin and has a rectangular outer configuration. The base member 70 is structured such that a front coupling portion 71 thereof is provided with an engagement hole 72 to which a semi spherical engagement portion 81 forming part of the lower end of an engagement rod 80 extending from a side of a rotating knob (not shown) is engaged, and an upper plate portion 74 and side plate portions 75 are formed backward of a vertical wall 71*a* of the coupling portion 71 to form a box shape to be open downward and backward. Collar portions 76 extend inward from both the side plate portions 75 to be close to the upper plate portion 74 to form a clearance for passing the base portion 61 of the contact point member 60 between the collar portion 76 and the upper plate portion 74. An engagement concave portion 77 is provided in an inner wall of the upper plate portion 74 for engagement to the engagement piece 67 of the contact point member 60, and a shallow guide groove 78 extends from the engagement concave portion 77 to a rear end opening of the base member 70. The guide groove 78 has a width allowing the passing of the engagement piece 67 of the contact point member 60. In the figure, numeral 79 indicates an extrusion hole for molding for forming the collar portions 76.

The grasping portion 65 is gripped by fingers and the base portion 61 of the contact point member 60 is inserted between the upper plate portion 74 and the collar portions 76 in the base member 70 from the front edge to be pressed in forward. Then the engagement piece 67 is guided in a deflected state inside the guide groove 78 of the upper plate portion 74. When a front edge of the base portion 61 is pushed and pressed in until a front edge of the base portion 61 makes contact with the vertical wall 71*a* of the coupling portion 71, the engagement piece 67 reaches the engagement concave portion 77 and a tip end thereof projects and engages into the engagement concave portion 77 for engagement of the contact point member 60. Therefore the contact point member 60 is sandwiched between the collar portions 76 and the upper plate portion 74 to be positioned and held therein, and the engagement between the engagement piece 67 and the engagement concave portion 77 prevents the contact point member 60 from falling down.

However, in the conventional mounting structure of the contact point member, the base portion 61 of the contact point member 60 is pushed and pressed in the narrow clearance between the upper plate portion 74 and the collar portions 76 in the base member 70 in a sliding direction over a relatively long distance at the mounting operation and advances with the engagement piece 67 being deflected during the sliding movement. Therefore a relatively high pushing and pressing force is required.

SUMMARY OF THE INVENTION

Accordingly, the present invention is made in view of the above described problems, and the present invention has an object to provide a mounting structure of a contact point member in a switch device excellent in a mounting operation.

For this purpose, according to an aspect of the present invention, a mounting structure of a contact point member in a switch device comprising a base member, another member, and contact point members mounted to the base member and the other member, which move relatively with each other for connection and disconnection, wherein the contact point member mounted to the base member includes a base portion, and a gripping portion and a contact point piece respectively extending from a rear end of the base portion, the base member includes a holding portion exposed to an open space and provided with a placement surface for placing the base portion of the contact point member mounted to the base member, a presser portion for pressing a front end of the base portion, an engagement hole formed in a vertical surface connecting to the placement surface of the holding portion, and a positioning portion for regulating a position of the contact point member mounted to the base member on a plane including the placement surface, wherein the gripping portion of the contact point member mounted to the base member is provided with an engagement piece which moves from a position adjacent to the engagement hole of the vertical surface to be engaged to the engagement hole when the gripping portion is pressed in a direction of the holding portion.

According to the aspect of the present invention, after the base portion of the contact point member mounted to the base member is placed on the holding portion with the upper space opened and the position of the contact point member on the plane is regulated by the positioning portion, the presser portion and the engagement of the engagement piece to the engagement hole prevents the falling-down of the contact point member, and the engagement of the engagement piece to the engagement hole is simply performed by pressing down the gripping portion. Therefore the mounting operation of the contact point member is easy. That is, it is not necessary to slide and move the base portion of the contact point member mounted to the base member over a long distance in a narrow space for the positioning until the engagement of the engagement piece to the engagement hole, and a distance setting by which the engagement piece slides on the vertical surface of the holding portion with the engagement piece being deflected may be short. Therefore the pressing-down force of the gripping portion can be reduced.

BRIEF DESCRIPTION OF THE DRAWINGS

Other objects, features, and advantages of the present invention will become more apparent from the following detailed description made with reference to the accompanying drawings, in which like parts are designated by like reference numbers and in which:

FIG. 10 is an enlarged cross section showing the mounting block to which the contact point member is mounted in the embodiment;

DESCRIPTION OF THE EMBODIMENTS

Figure 1:
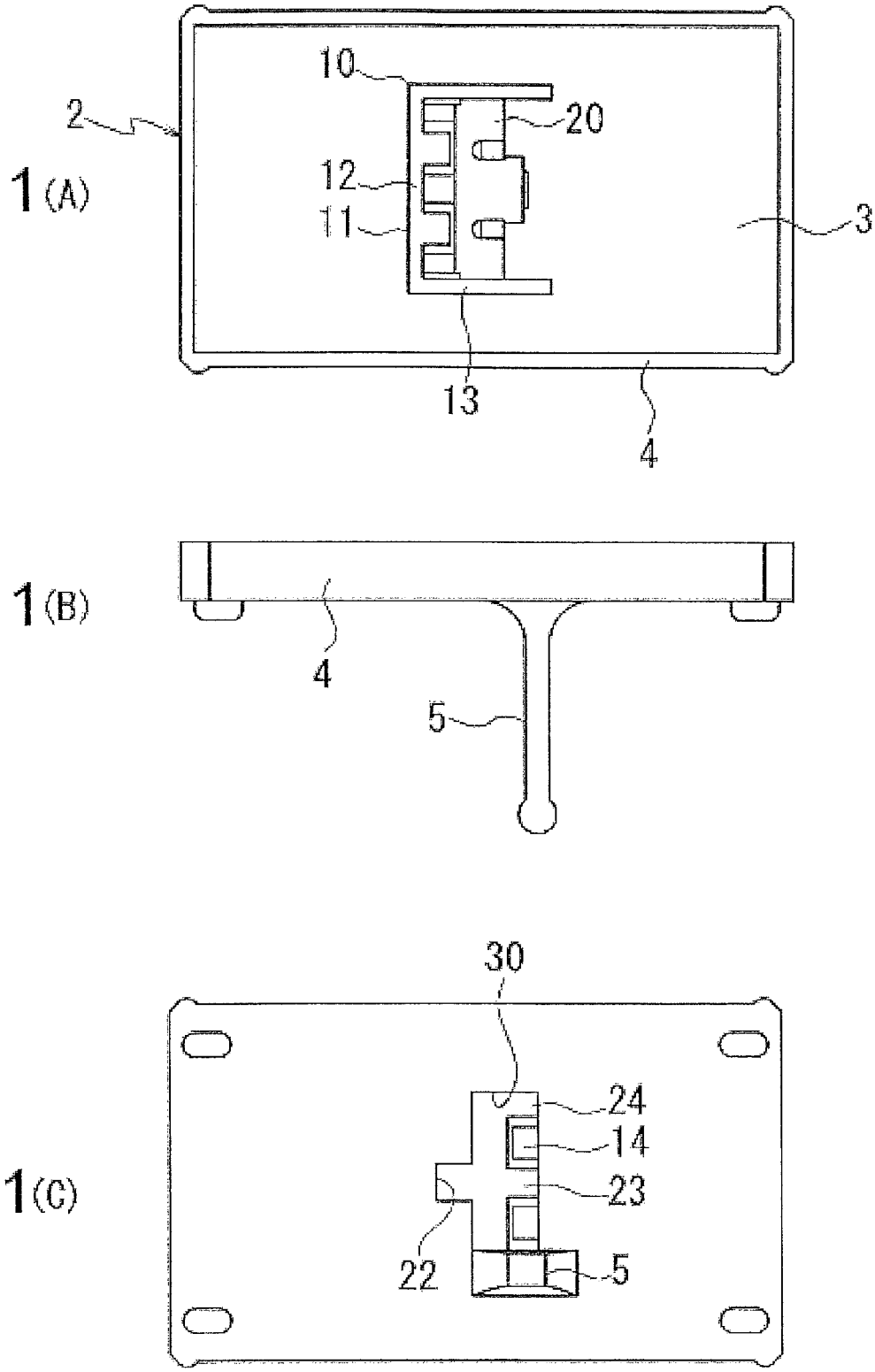
FIGS. 1A, 1B and 10 are diagrams each showing the construction in an embodiment of the present invention.

Hereinafter, an embodiment in which the present invention is applied to a slider in which a movable contact point to a fixed side contact point as a contact point member is mounted to a base member will be described in detail with reference to the accompanying drawings. FIG. 1A is a plan view, FIG. 1B is a side view, and FIG. 1C is a rear view, each showing a base member in an embodiment. A base member 2 of a slider 1 (refer to FIG. 9) is made of resin and is formed in a box frame shape in such a manner that an outer peripheral wall 4 is elevated from each section of a bottom wall 3 having a rectangular plane to open upward. The base member 2 has the rear side provided with a coupling lever 5 elevated from an intermediate position of the side section along a longitudinal direction of the bottom wall 3. The coupling lever 5 is positioned in the vicinity of one side section of the bottom wall 3.

A mounting block 10 is formed in the center of the upper surface of the bottom wall 3. The mounting block 10 is formed of a gate-shaped surrounding wall 11 including a main wall 12 and side walls 13 extending in parallel in the same direction from both ends of the main wall 12, and a holding portion 20 connecting to both the side walls 13 in the surrounding wall 11. The surrounding wall 11 is structured such that the side walls 13 are arranged along the longitudinal direction of the bottom wall 3, the main wall 12 is arranged perpendicular to the longitudinal direction, and each upper edge of the main wall 12 and the side wall 13 is slightly lower than a height of the outer peripheral wall 4. Hereinafter, for convenience, a front-rear relation will be explained by defining a side of the main wall 12 as a front side and a direction, where the side wall 13 extends, as a rear side.

Figure 2:
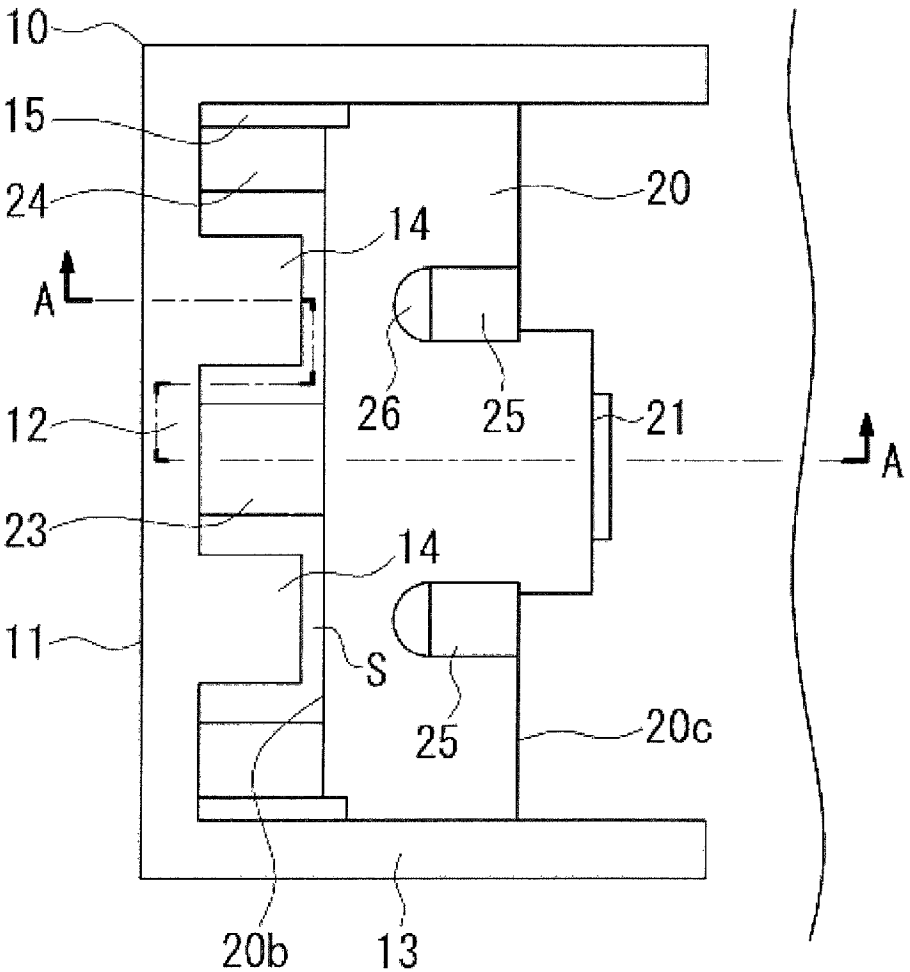
FIG. 2 is an enlarged partial plan view showing a mounting block in the embodiment.
Figure 3:
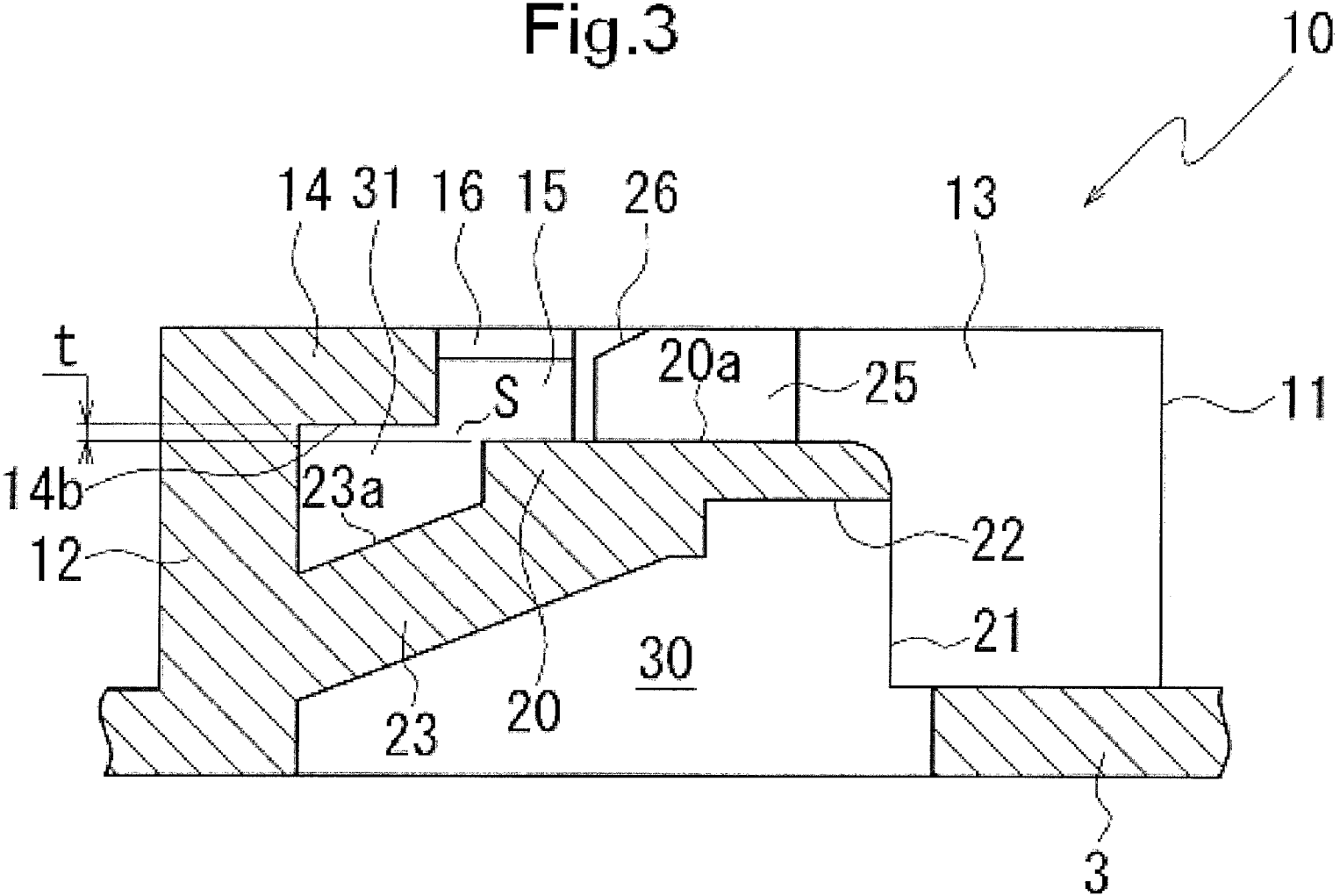
FIG. 3 is an enlarged cross section showing the mounting block in the embodiment.
Figure 4:
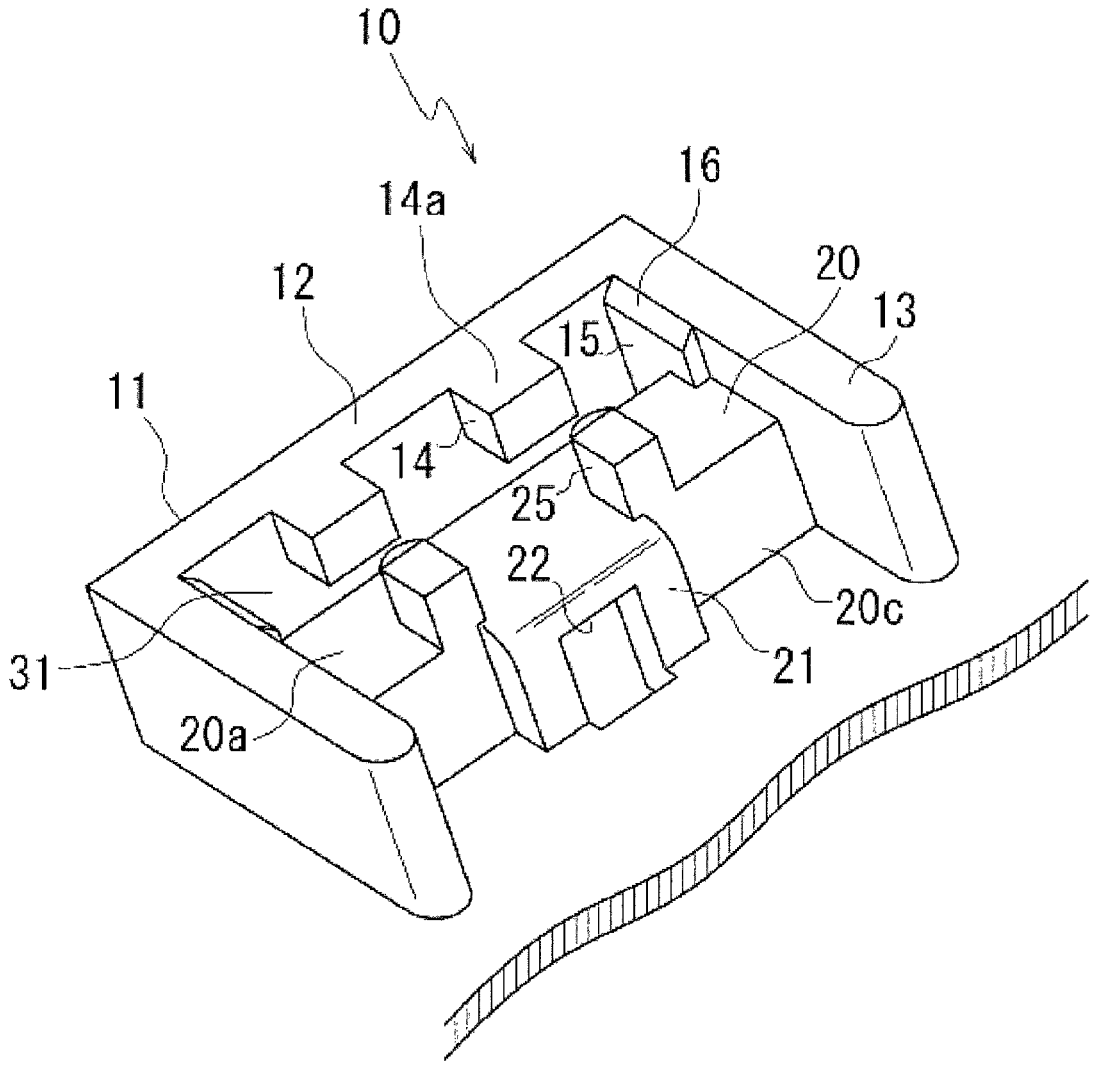
FIG. 4 is a perspective view showing the mounting block in the embodiment.
Figure 5:
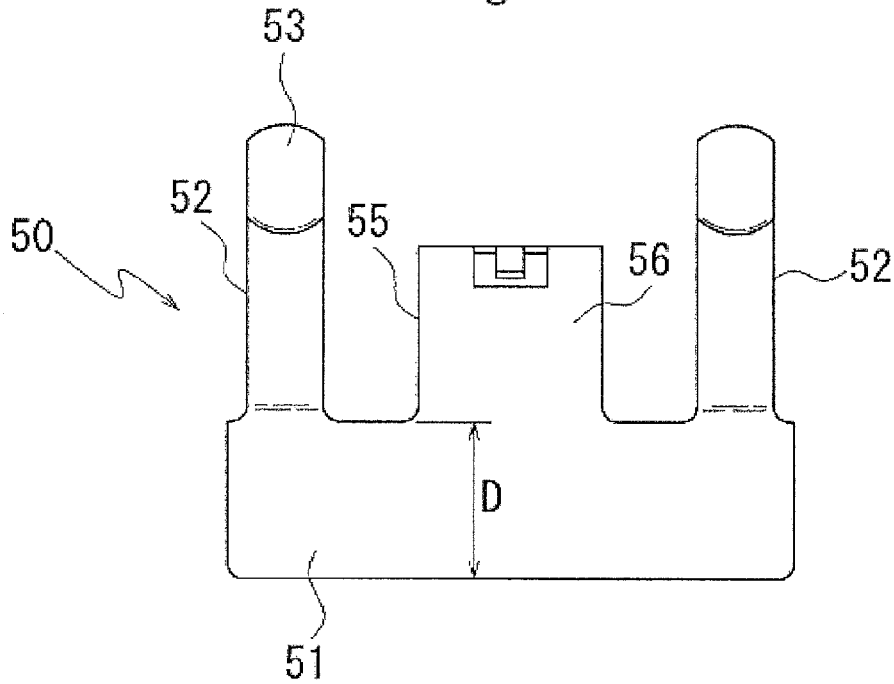
FIGS. 5A, 5B, and 5C are diagrams showing a contact point member in the embodiment.
Figure 5:
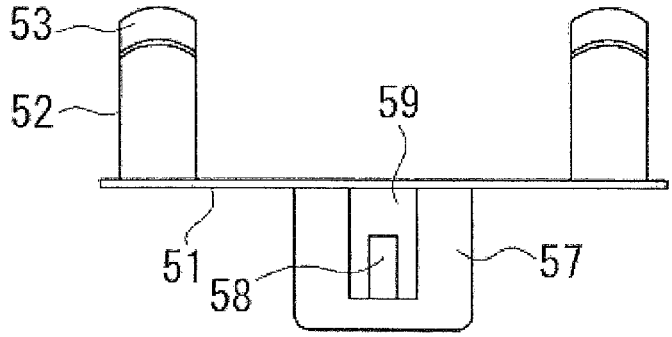
Figure 5:
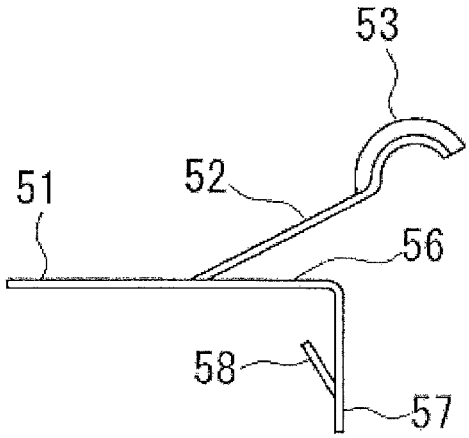

FIG. 2 is an enlarged plan view of a mounting block 10 in the base member. FIG. 3 is a cross section taken along section A-A in FIG. 2. FIG. 4 is a perspective view. Two presser portions 14, each having a square block shape, extend from an upper end section of the main wall 12 to the rear side (the same direction as the side wall 13) by a predetermined length to divide a space between the side walls 13 substantially into three sections. The presser portion 14 has an upper surface 14*a* which is in flush with the upper edge of the main wall 12 and a lower surface 14*b* which is a plane in parallel and with a clearance t to an upper surface 20*a* of the holding portion 20 and which is higher by a thickness amount of a contact point member 50 to be described later than the upper surface 20*a*. An extension portion 15 having a predetermined thickness is provided in each of the side walls 13 over a range from the main wall 12 to the upper surface 20*a* of the holding portion 20. A distance between the extension portions 15 is set corresponding to a width of a base portion 51 of the contact point member 50 (refer to FIG. 5). An upper end of the extension portion 15 is formed as an inclined surface 16 having an upper edge connected to an upper edge of the side wall 13 and having a lower height toward the inside direction.

The holding portion 20 has the flat upper surface 20*a* in parallel with the bottom wall 3 at a height approximately two-thirds of the side wall 13 and has stoppers 25 on the upper surface 20*a* to oppose the presser portions 14 of the main wall 12. The upper surface 20*a* forms part of a placement surface for placing the contact point member 50 (base portion 51). An upper surface of the stopper 25 is as high as the upper surface 14*a* of the presser portion 14, a width thereof is small than a width of the presser portion 14, a plane of a front end thereof opposing the presser portion 14 is formed in a semi arc shape, and a rear end thereof is in flush with a rear surface 20*c* of the holding portion 20. A distance between the main wall 12 and a front end of the stopper 25 corresponds to a length of the base portion 51 in the contact point member 50 in the front-rear direction (refer to FIG. 5). The front-side upper end of the stopper 25 is chamfered to form a lower inclined surface 26 toward the front side. A front surface 20*b* of the holding portion 20 is set to a predetermined distance from the rear end of the presser portion 14, and the contact point member 50 is pressed down and inserted under the presser portion 14 through a clearance S therebetween.

A projection 21 is formed in the center in the width direction on a rear surface 20*c* of the holding portion 20 to project backward of both the sides thereof. A width of the projection 21 is slightly larger than a distance between opposing surfaces of the two stoppers 25, and a corner from the upper surface 20*a* to the projection 21 (rear surface) forms part of a smooth curved surface. The projection 21 is provided with a corner hole 22. The corner hole 22 is formed from the backside of the bottom wall 3 with a molding tool and reaches the bottom wall 13 to extend from the projection 21 to the backside by a predetermined amount.

A bridge 23 is provided in the center in the width direction and bridges 24 are provided in both ends in the width direction between the main wall 12 and the front surface 20*b* of the holding portion 20. The bridges 23 and 24 do not overlap the presser 14 on a plan view. The bridges 24 at both the ends are connected to the extension portions 15. The bridges 23 and 24 have upper surfaces 23*a* and 24*a* each inclined forward and downward from a position lower by a predetermined amount from the upper surface 20*a* of the holding portion 20. A lightening hole 30 corresponding to the mounting block 10 is formed in the backside of the base member 2. The corner hole 22 provided in the projection 21 and a lower side space of each of the presser portion 14 and the bridges 23 and 24 form a part of the lightening hole 30, and the lightening hole 30 forms part of a concave portion 31 as viewed from the front side.

Figure 6:
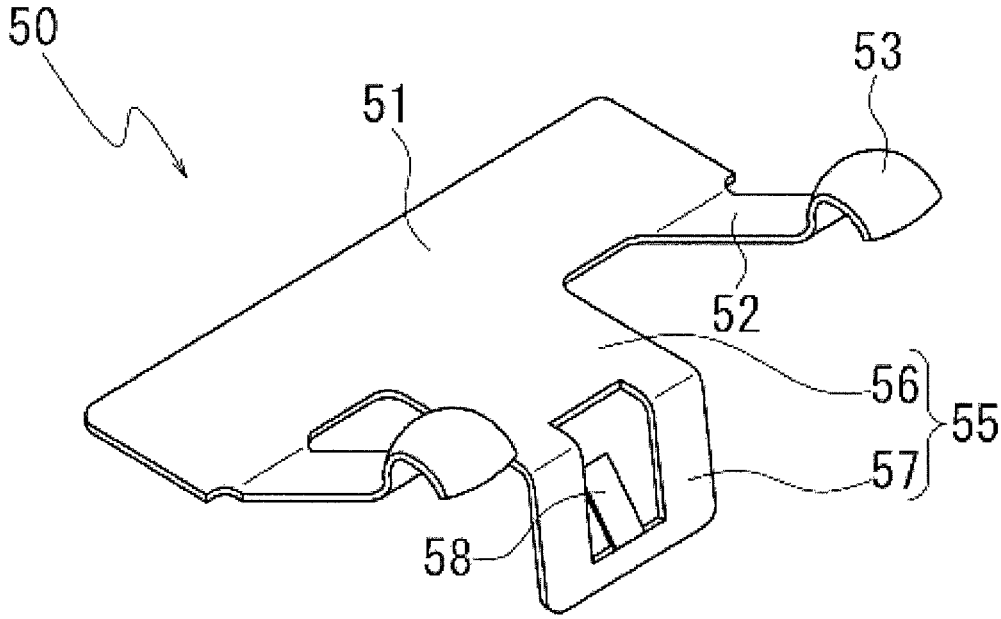
FIG. 6 is a perspective view showing the contact point member in the embodiment.

Next, the contact point member 50 will be explained. FIG. 5A is a plan view showing the contact point member 50, FIG. 5B is a front view showing the contact point member 50, and FIG. 5C is a side view showing the contact point member 50. FIG. 6 is a perspective view showing the contact point member 50. The contact point member 50 is formed from a copper plate by press molding and comprises the rectangular base portion 51, contact point pieces 52 extending in parallel and backward from the base portion 51 in the vicinity of both ends in the width direction (longitudinal direction) thereof, and contact point portions 53 molded in a semi spherical surface at the tip ends of the contact point pieces 52. The outer section of the contact point piece 52 in the width direction is formed to be shifted inward by a predetermined amount from each of the right and left end edges of the base portion 51. A length D of the base portion 51 in the front-rear direction corresponds to a distance between the main wall 12 and the front end of the stopper 25. The contact point piece 52 is bent upward by a predetermined angle at the bottom and the contact point portion 53 has a semi spherical surface bulged in the bent side. The contact point member 50 is provided with a gripping portion 55 extending from the base portion 51 at the center in the width direction to the same side as the contact point piece 52.

The griping portion 55 has a width slightly smaller than a clearance between the stoppers 25 of the holding 20 to be capable of passing through the clearance and is formed of an extension plate section 56 extending in flush with the base portion 51 backward and a falling-down preventive section 57 extending perpendicularly and downward from a tip end of the extension plate section 56. A length of the falling-down preventive section 57 corresponds substantially to a height from the bottom wall 3 to the upper surface 20*a* of the holding portion 20. The falling-down preventive section 57 is provided with an engagement piece 58 in which the periphery is surrounded by a slit 59, a side of the tip end (lower end) forms part of a bottom, and a side of the connection to the extension plate section 56 forms part of a free end. The engagement piece 58 is bent at a side of the bottom toward the base portion 51. In the contact point member 50 based upon the aforementioned construction, since the gripping portion 55 can be accommodated between the two contact point pieces 52 even in a state of being developed, the contact point member 50 is excellent in a yield rate.

Figure 7:
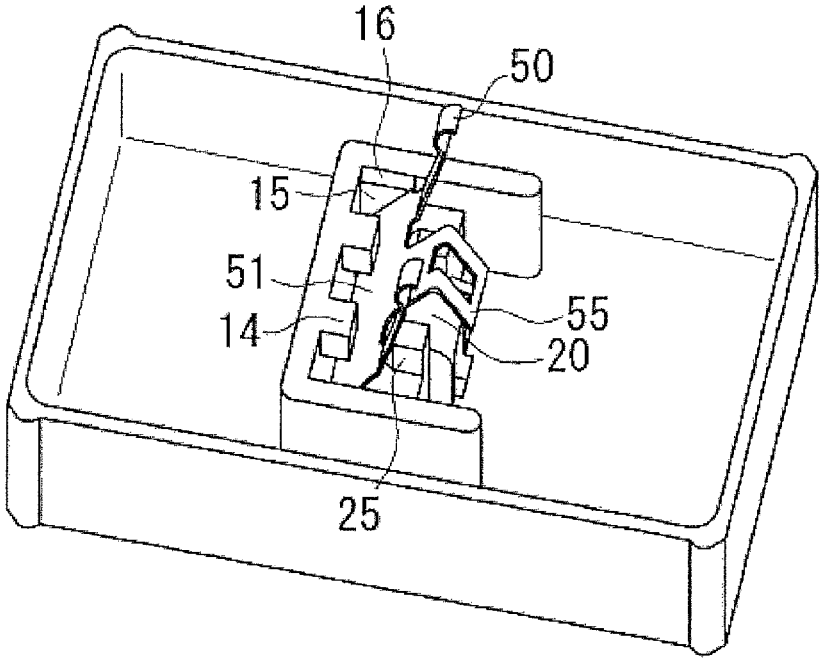
FIGS. 7A and 7B are explanatory diagrams showing a mounting method of the contact point member in the embodiment.
Figure 7:
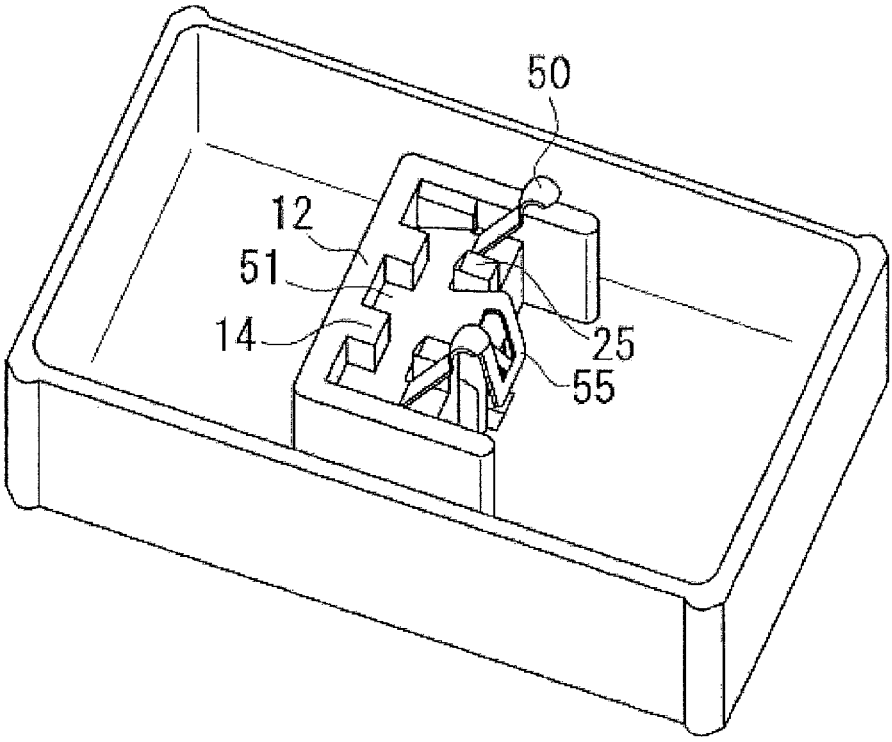

The aforementioned contact point member 50 is mounted to the base member 2 in the following method. First, the contact point member 50 is held by taking hold of the gripping portion 55 with a hand or a pin set (hereinafter, called a hand or the like). On this occasion, since the holding portion 55, particularly the falling-down preventive section 57 extends in a direction at the opposite to the bent direction (inclination direction) of the contact point piece 52, a wide space can be ensured, causing the gripping portion 55 to be easily taken hold. The contact point member 50 is held by a hand or the like, and the front end of the base portion 51 is, as shown in FIG. 7A, inserted into the concave portion 31 between the extension portions 15 from the clearance between the tip end of the presser portion 14 in the main wall 12 and the holding portion 20 in the surrounding wall 11. Since the clearance can be set in no relation to the thickness of the contact point member 50, there occurs no resistance to the inserting. At this time also, since the gripping portion 55 is in the central position to be sandwiched between the two contact point pieces 52, the contact point member 50 can be inserted in a stable, appropriate posture. Since the inclination surface 16 is formed on the upper end of the extension portion 15 in the side wall 13 of the surrounding wall 11, at the time of inserting the base portion 51 the contact point member 50 can be smoothly guided between the extension portions 15 along the inclination surface 16 even if the right and left ends of the base portion 51 are shifted.

Figure 8:
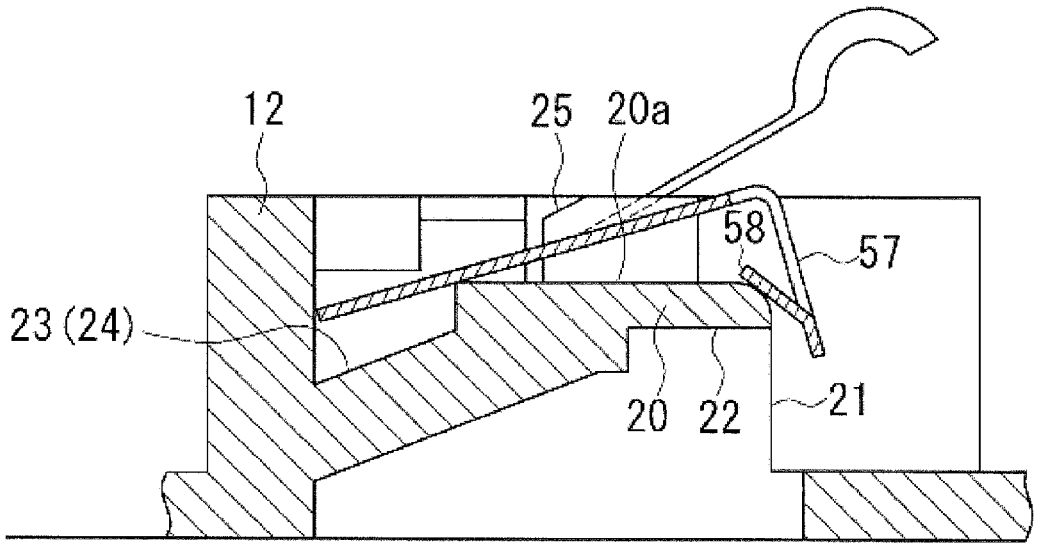
FIG. 8 is a cross section showing a state of the contact point member in a setting position in the embodiment.

After the front end of the base portion 51 is inserted to a position close to the bridges 23 and 24 as the contact point member 50 maintains the initial inserting state, when a hand or the like is released from the gripping portion 55, the contact point member 50 slides on the bridges 23 and 24 by a self-weight thereof and along with it, by the downward inclination of the bridges 23 and 24 toward the main wall 12, and falls down to a setting position as shown in FIG. 7B. The setting position is, as shown in a cross section of FIG. 8, a state where the engagement piece 58 of the falling-down preventive section 57 in the gripping portion 55 is in a position close to the center of the curved surface from the upper surface 20*a* of the holding portion 20 over the projection 21. The rear end edge of the base portion 51 is in a position opposing the stopper 25 on the holding portion 20.

Figure 9:
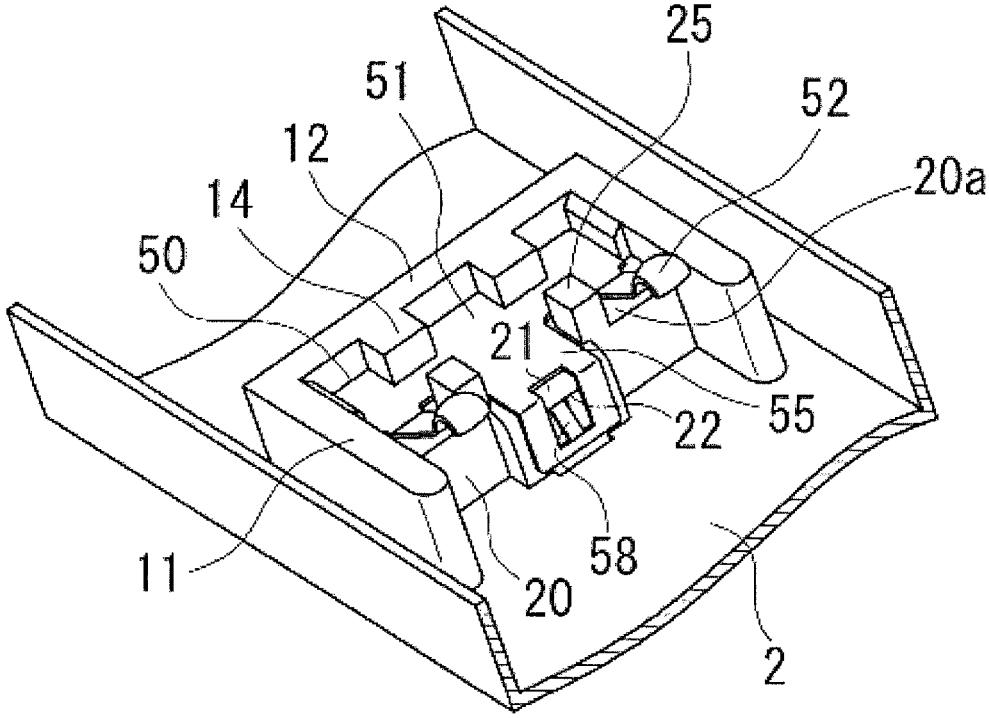
FIG. 9 is a perspective view showing the mounting block to which the contact point member is mounted in the embodiment.
Figure 10:
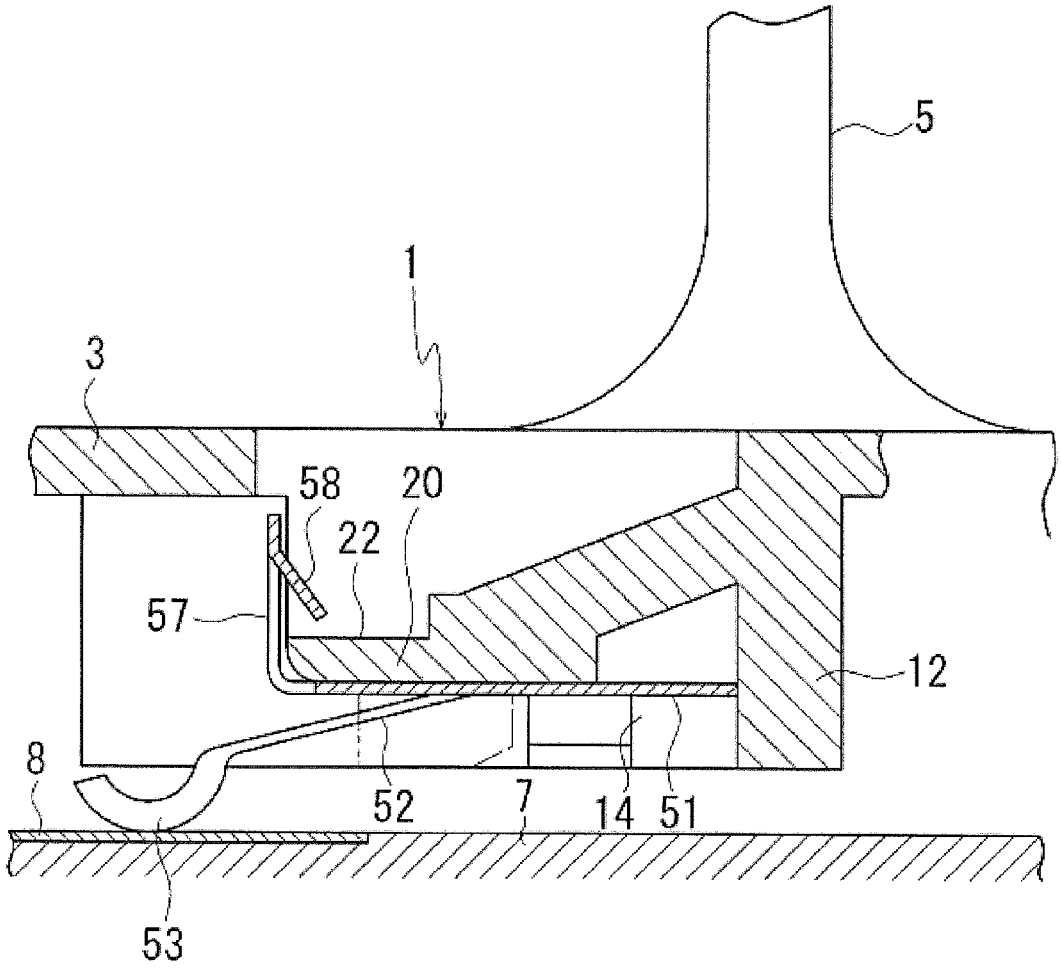

Here, when the base portion 51 presses down the rear end of the extension plate section 56 in the gripping portion 55 in a direction of being seated on the upper surface 20*a* of the holding portion 20, the engagement piece 58 is resiliently deformed to slide on the curved surface and to be engaged to the hole edge of the corner hole 22. On the other hand, due to the pressing-down of the extension plate section 56, the base portion 51 rotates around a front end edge of the upper surface 20*a* of the holding portion 20 as a fulcrum and a front end section of the base portion 51 makes contact with the lower surface 14*b* of the presser portion 14 to place the base portion 51 on the holding portion 20, thus completing the mounting operation of the contact point member 50. FIG. 9 is a perspective view showing the mounting state. FIG. 10 to be illustrated later is referred to as a cross section of the mounting state. The contact point member 50 is positioned by sandwiching the base portion 51 between the main wall 12 and the stopper 25, and the slipping-out of the contact point member 50 can be prevented by the engagement between the base portion 51 and the presser portion 14 and the engagement between the engagement piece 58 of the falling-down preventive section 57 and the corner hole 22.

The slider 1 in which the contact point member 50 is mounted to the base member 2 as described above is reversed in front and back to be incorporated in the switch device. FIG. 10 is a cross section showing the use state. The slider 1 is arranged to oppose the insulating substrate 7 in which a fixed contact point 8 is installed, and a tip end of the coupling lever 5 is coupled to a knob (not shown), and the slider 1 slides with an operation of the knob. Thereby the contact point portions 53 of the contact point member 50 are connected and disconnected from the fixed contact point 8. Since the contact point pieces 52 of the contact point member 50 are shifted from the right and left end edges of the base portion 51, the contact point pieces 52 do not interfere with the extension portions 15 or the side walls 13 of the mounting block 10.

Clearances penetrating through the front and rear sides of the bottom wall 3 are formed around the presser portion 14 and the bridges 23 and 24 in the base member 2, but since these clearances are closed by mounting the contact point member 50 therein, it prevents foreign objects such as dusts from entering into the base member 2 in which the contact point portions 53 are positioned through these clearance.

In the present embodiment, the contact point member 50 corresponds to the contact point member mounted to the base member, and the fixed contact point 8 corresponds to the contact point member mounted to the other member in the present invention. The positioning portion is constructed of the surrounding wall 11 and the stopper 25, the side walls 13 correspond to the two opposing sections of the surrounding wall 11, and the inclination surface 16 corresponds to the guide surface. The upper surface 20*a* of the holding portion 20 corresponds to the placement surface, and the rear surface 20*c* of the projection 21 corresponds to the vertical surface.

The present embodiment is constructed as described above, and in the switch device provided with the contact point member 50 and the fixed contact point 8 which are mounted respectively to the base member 2 and the insulating substrate 7 and which move relatively with each other to be connected and disconnected from each other, the contact point member 50 mounted to the base member 2 includes the base portion 51, and the gripping portion 55 extending from the base portion 51 at the center in the width direction, and the contact point pieces 52 extending from the base portion 51 at both the sides of the gripping portion 55, wherein the base member 2 includes the holding portion 20 exposed to an open space and provided with the upper surface 21*a* for placing the base portion 51, the presser portions 14 for pressing the front end of the base portion 51, the corner hole 22 formed in the rear surface 20*c* connecting to the upper surface 20*a* of the holding portion 20, and the surrounding wall 11 and the stoppers 25 for regulating the position of the contact point member 50 on the plane including the upper surface 20*a* of the holding portion 20, wherein the gripping portion 55 of the contact point member 50 is provided with the engagement piece 58 which moves from the position adjacent to the corner hole 22 of the rear surface 20*c* to be engaged to the corner hole 22 when the gripping portion 55 is pressed in the direction of the holding portion 20. In consequence, the contact point member 55 can be mounted by holding the gripping portion 55, and it is not necessary to hold the contact point piece 52 during the mounting operation. Therefore there is no possibility that damages such as bending or twisting the contact point piece 52 or the contact point portion 53 are generated in the contact point member 50.

After the base portion 51 is placed on the holding portion 20 and the position of the contact point member 50 on the plane is regulated by the surrounding wall 11 and the stoppers 25, the presser portion 14 and the engagement between the engagement piece 58 and the corner hole 22 prevents the falling-down of the contact point member 50, and the engagement between the engagement piece 58 and the corner hole 22 is simply performed by pressing down the gripping portion 55. Therefore the mounting operation of the contact point member 50 is easy. Further, it is not necessary to slide and move the base portion 51 of the contact point member 50 over a long distance since the base portion 51 of the contact point member 50 is only placed on the upper surface 20*a* of the holding portion 20 for the positioning until the engagement of the engagement piece 58 to the corner hole 22, and in addition, since the distance by which the engagement piece 58 is deflected and slides on the rear surface 20*c* of the holding portion 20 can be short, the pressing-down force can be reduced. Further, the distance by which the engagement piece 58 slides on the rear surface 20*c* of the holding portion 20 is short and the cutting scraps are not almost generated. In addition, since the corner hole 22 is open to an outside at the backside of the base member 2, even if the cutting scraps and abrasion powders are generated, they are released to an outside and do not remain in the base member 2, giving no damage to the switching function.

Since the inclination surface 16 for guiding the base member 51 into the surrounding wall 11 is provided on the upper end edge of each of the opposing side walls 13 of the two sections in the surrounding wall 11, even if the right and left ends of the base portion 51 are shifted at the mounting of the contact point member 50, the contact point member 50 is smoothly guided between the side walls 13 without any engagement.

Since the stoppers 25 are provided on the upper surface 20*a* of the holding portion 20 in the same way with the placement of the base portion 51, it is possible to position and hold the contact point member 50 with high rigidity. In addition, the gripping portion 55 of the contact point member 50 comprises the extension plate section 56 extending in flush with the base portion 51 and the falling-down preventive section 57 bent from the tip end of the extension plate section 56 to be positioned along the rear surface 20*c* of the holding portion 20, and the engagement piece 58 is formed in the falling-down preventive section 57. Therefore when a hand or the like is released from the gripping portion 55, since the contact point member 50 falls over and the engagement piece 58 of the falling-down preventive section 57 is positioned close to the center of the curved surface from the upper surface 20*a* of the holding portion 20 over the projection 21, the engagement piece 58 can be easily engaged to the corner hole 22 simply by pushing the tip end of the extension plate section 56.

Since the falling-down preventive section 57 of the gripping portion 55 in the contact point member 50 extends in a direction opposing the inclination direction of the contact point piece 52 to the plane of the base portion 51, a wide space can be ensured, causing easy holding of the gripping portion 55.

Since the presser portions 14 are provided in the surrounding wall 11, the surrounding wall 11 has the positioning function and in addition, forms a part of the falling-down preventive structure, enabling a simple construction of the switch device. Since the lower surface 14*b* of the presser portion 14 is set in parallel with the upper surface 20*a* of the holding portion 20 to form the clearance t corresponding to the thickness of the base portion 51 of the contact point member 50 therebetween, the base portion 51 makes surface contact with each of the lower surface 14*b* of the presser portion 14 and the upper surface 20*a* of the holding portion 20, and the contact point member 50 can be particularly stably positioned and held.

As viewed from the above direction perpendicular to the upper surface 20*a* of the holding portion 20, the clearance S is provided between the presser portion 14 and the holding portion 20, and the bridges 23 and 24 are provided under the presser portions 14, each having the wall surface inclined downward toward the main wall 12. Therefore when the front end of the bas portion 51 is pressed and inserted into the clearance S and a hand or the like is released from the gripping portion 55, the contact point member 50 slides on the bridges 23 and 24 by a self-weight thereof, and falls over backward to a setting position where the engagement piece 58 of the gripping portion 55 is positioned close to the center of the curved surface from the upper surface 20*a* of the holding portion 20 over the projection 21. Therefore, after that, as described above, the mounting operation of the contact point member 50 can be easily completed simply by pushing the tip end of the extension plate section 56 of the gripping portion 55.

Figure 11:
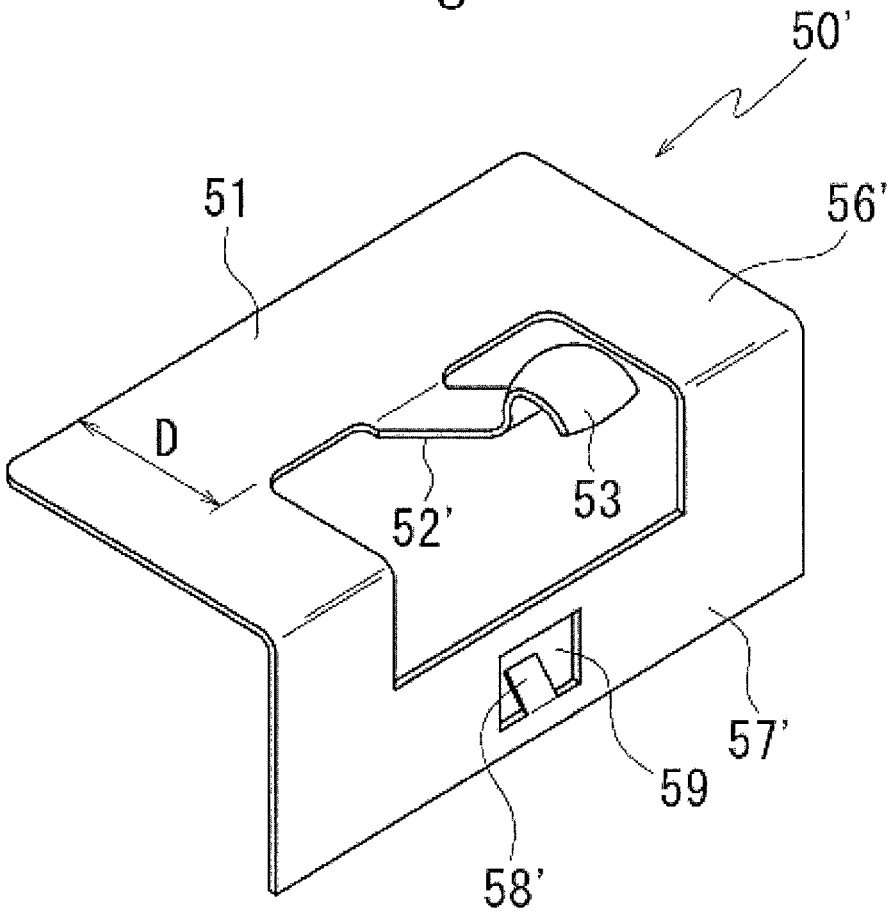
FIG. 11 is a perspective view showing a modification of the contact point member in the embodiment.
Figure 12:
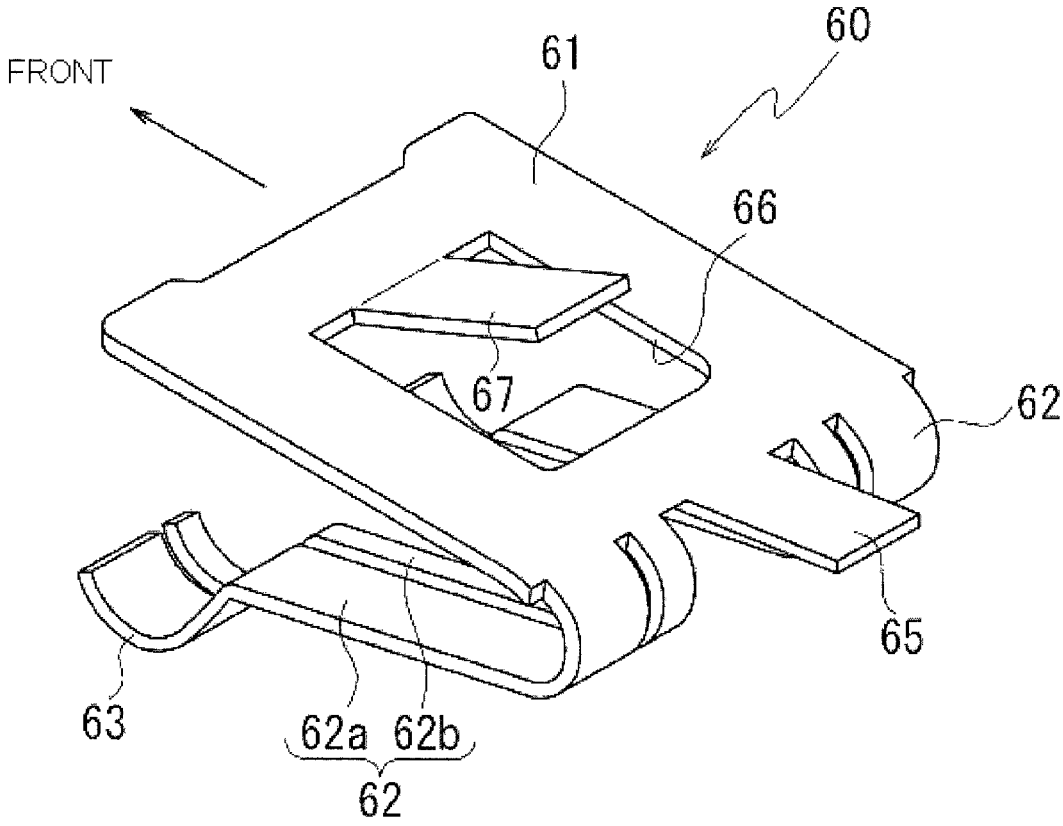
FIG. 12 is a perspective view showing a contact point member in the conventional example.
Figure 13:
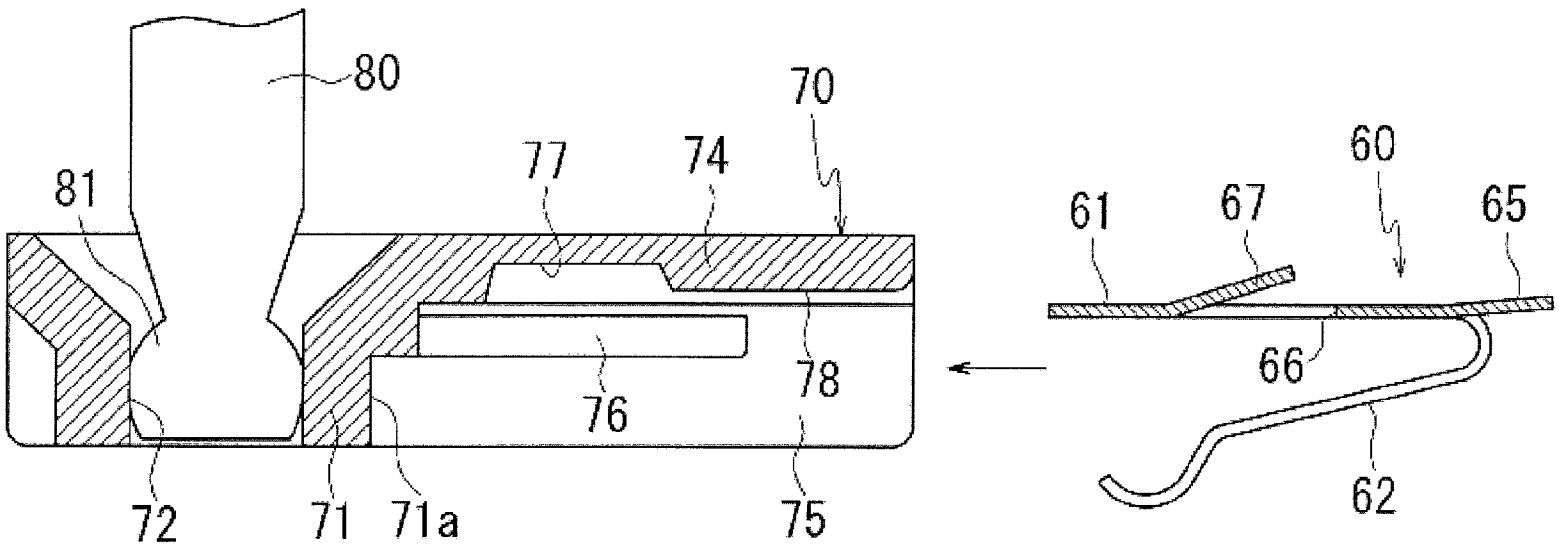
FIG. 13 is a cross section showing a base member and the contact point member before the contact point member is mounted thereto in the conventional example.
Figure 14:
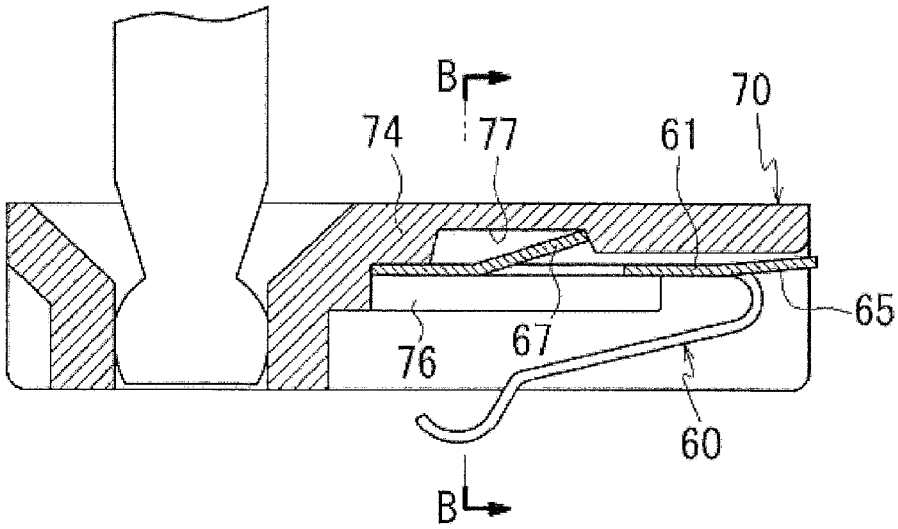
FIG. 14 is a diagram showing a slider in a mounting state in the conventional example.
Figure 14:
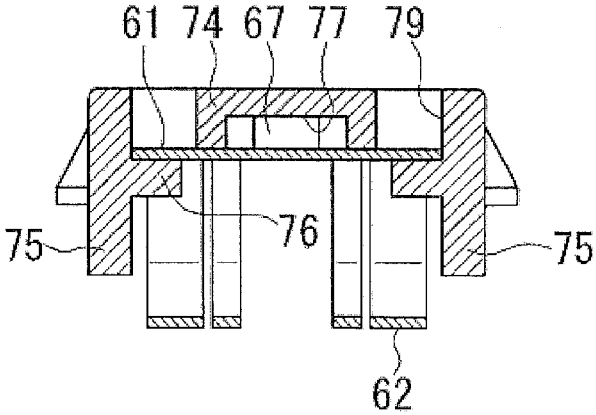

Next, FIG. 11 shows a perspective view showing a modification in which a configuration of a contact point member mounted to the base member is different from that of the above embodiment. This modification is appropriate for a case of a single contact point piece. A contact point member 50' comprises extension plate sections 56' extending in flush with the rectangular base portion 51 backward from both ends of the base portion 51 in the width direction (longitudinal direction) and a falling-down preventive section 57' which is bent and extends downward at a front end of the extension plate section 56'. The falling-down preventive section 57' comprises side pieces extending to the downward side and a lateral piece extending in the width direction between the tip ends of the side pieces for the connection. The base portion 51 is provided with a contact point piece 52' extending in the same direction with the extension plate section 56' from the center thereof in the width direction and a contact point portion 53 at the tip end of the contact point piece 52', which is formed in a semi spherical shape. The contact point piece 52' is bent upward by a predetermined angle at the bottom, and the contact point portion 53 has the semi spherical surface bulged in the bent side. A length D of the base portion 51 in the front-rear direction corresponds to a distance between the main wall 12 and the front end of the stopper 25, and the rear edge of the base portion 51 between the contact point piece 52' and the extension plate section 56' forms part of a contact portion with the stopper 25.

An engagement piece 58' the periphery of which is surrounded by the slit 59 is formed in the center of the falling-down preventive section 57' in the width direction, that is, the center of the lateral piece, and is, as similar to the engagement piece 58 in the above embodiment, formed to be bent toward the base portion 51 at a lower end side bottom of the falling-down preventive section 57' and to direct a free end thereof upward. The other structure is identical to that of the contact point member 50. It should be noted that in a case where a height position of the engagement piece 58' from the surface of the base portion 51 is different, although not illustrated particularly, the corner hole 22 in rear surface 20*c* of the holding portion 20 may be set in a height position where the engagement piece 58' is engaged at the time of placing the base portion 51 on the upper surface 20*a* of the holding portion 20. In the contact point member 50' in the modification, the extension plate sections 56' may be held as the gripping portion on assembling or the falling-down preventive section 57' may be held. In addition, in the contact point member 50', since a development configuration including the contact point piece 52' is formed in a simple square shape, the yield rate in material is, as similar to the above embodiment, excellent.

In the above embodiment, an explanation is made of a case of the mounting structure in the slider where the contact point member 50 forms part of the movable contact point, but the present invention is not limited thereto, and may be applied to a case where the contact point member forms part of the fixed contact point.

While only the selected embodiments have been chosen to illustrate the present invention, it will be apparent to those skilled in the art from this disclosure that various changes and modifications can be made therein without departing from the scope of the invention as defined in the appended claims. Furthermore, the foregoing description of the embodiments according to the present invention is provided for illustration only, and not for the purpose of limiting the invention as defined by the appended claims and their equivalents.

DESCRIPTION OF REFERENCE SIGNS

1 SLIDER
2 BASE MEMBER
3 BOTTOM WALL
4 OUTER PERIPHERAL WALL
5 COUPLING LEVER
7 INSULATING SUBSTRATE
8 FIXED CONTACT POINT
10 MOUNTING BLOCK
11 SURROUNDING WALL
12 MAIN WALL
13 SIDE WALL
14 PRESSER PORTION
14*a* UPPER SURFACE
14*b* LOWER SURFACE
15 EXTENSION PORTION
16 INCLINED SURFACE
20 HOLDING PORTION
20*a* UPPER SURFACE (PLACEMENT SURFACE)
20*b* FRONT SURFACE
20*c* REAR SURFACE
21 PROJECTION
22 CORNER HOLE
23, 24 BRIDGE
25 STOPPER
26 INCLINED SURFACE
30 LIGHTENING HOLE
31 CONCAVE PORTION
50, 50' CONTACT POINT MEMBER (CONTACT POINT MEMBER MOUNTED TO BASE MEMBER)
51 BASE PORTION
52, 52' CONTACT POINT PIECE
53 CONTACT POINT PORTION
55 GRIPPING PORTION
56, 56' EXTENSION PLATE SECTION
57, 57' FALLING-DOWN PREVENTIVE PORTION
58 ENGAGEMENT PIECE
59 SLIT
60 CONTACT POINT MEMBER
61 BASE PORTION
62, 62*a*, 62*b* CONTACT POINT PIECE
63 CONTACT POINT PORTION
65 GRASPING PORTION
66 RECTANGULAR HOLE
67 ENGAGEMENT PIECE

70 BASE MEMBER
71 COUPLING PORTION
71*a* VERTICAL WALL
72 ENGAGEMENT HOLE
74 UPPER PLATE PORTION
75 SIDE PLATE PORTION
76 COLLAR PORTION
77 ENGAGEMENT CONCAVE PORTION
78 GUIDE GROOVE
79 EXTRUSION HOLE
80 ENGAGEMENT ROD
81 SEMI-SPHERICAL ENGAGEMENT PORTION

What is claimed is:

1. A mounting structure of a contact point member in a switch device comprising:

a base member;

another member; and contact point members mounted to the base member and the other member, which move relatively with each other for connection and disconnection, wherein the contact point member mounted to the base member includes a base portion, and a gripping portion and a contact point piece respectively extending from a rear end of the base portion, the base member includes a holding portion exposed to an open space and provided with a placement surface for placing the base portion, a presser portion for pressing a front end of the base portion, an engagement hole formed in a vertical surface connecting to the placement surface of the holding portion, and a positioning portion for regulating a position of the contact point member mounted to the base member on a plane including the placement surface, wherein the gripping portion of the contact point member mounted to the base member is provided with an engagement piece which moves from a position adjacent to the engagement hole of the vertical surface to be engaged to the engagement hole when the gripping portion is pressed in a direction of the holding portion.

2. A mounting structure of a contact point member in a switch device according to claim 1, wherein the gripping portion of the contact point member mounted to the base member comprises:

an extension plate section extending in flush with the base portion; and a falling-down preventive section bent from a tip end of the extension plate section to be positioned along the vertical surface of the holding portion, wherein the engagement piece is formed in the falling-down preventive section.

3. A mounting structure of a contact point member in a switch device according to claim 2, wherein the extension plate section of the contact point member mounted to the base member extends from the center of the base portion in the width direction, and the contact point pieces extend at both sides of the extension plate section.

4. A mounting structure of a contact point member in a switch device according to claim 2, wherein the extension plate sections of the contact point member mounted to the base member extend from both sides of the base portion in the width direction, and the contact point piece extends from the center of the base portion in the width direction.

5. A mounting structure of a contact point member in a switch device according to claim 2, wherein the contact point piece of the contact point member mounted to the base member is inclined to a plane of the base portion, and the falling-down preventive section extends in a direction opposing the inclination direction of the contact point piece to the plane of the base portion.

6. A mounting structure of a contact point member in a switch device according to claim 1, wherein the positioning portion comprises a surrounding wall for surrounding three sections of the base portion in the contact point member mounted to the base member, and stoppers arranged to sandwich the base portion between the surrounding wall and the stopper.

7. A mounting structure of a contact point member in a switch device according to claim 6, wherein A guide surface for guiding the base portion into the surrounding wall is provided on an upper end edge of each of walls of two opposing sections in the surrounding wall.

8. A mounting structure of a contact point member in a switch device according to claim 6, wherein the stopper is provided on the placement surface of the holding portion.

9. A mounting structure of a contact point member in a switch device according to claim 6, wherein the presser portion is provided in the surrounding wall.

10. A mounting structure of a contact point member in a switch device according to claim 9, wherein the presser portion of the surrounding wall has a lower surface which is set in parallel with the placement surface of the holding portion to form a clearance t corresponding to the thickness of the base portion of the contact point member mounted to the base member therebetween.

11. A mounting structure of a contact point member in a switch device according to claim 10, wherein as viewed in a direction perpendicular to the placement surface of the holding portion, a clearance is provided between the presser portion and the holding portion, and a bridge is provided under the presser portion, the bridge having a wall surface inclined downward toward one section in parallel with the clearance in the surrounding wall.

12. A mounting structure of a contact point member in a switch device according to claim 1, wherein the engagement hole is opened to an outside of a space where the contact point member mounted to the base member is positioned.

* * * * *